United States Patent [19]

Godlewski

[11] Patent Number: 4,470,349

[45] Date of Patent: Sep. 11, 1984

[54] ARTICLE CONTROLLED SHEET FEEDING AND PRINTING MACHINE

[76] Inventor: Edward S. Godlewski, 129 S. Spruce, Wooddale, Ill. 60191

[21] Appl. No.: 495,224

[22] Filed: May 19, 1983

Related U.S. Application Data

[63] Continuation-in-part of Ser. No. 257,557, Apr. 27, 1981, abandoned.

[51] Int. Cl.[3] ..... B41F 5/02; B41F 21/12; B65H 9/04

[52] U.S. Cl. ..... 101/233; 101/76; 101/242; 271/246

[58] Field of Search ..... 101/76, 77, 85–88, 101/233, 234, 242; 271/245, 246

[56] References Cited

U.S. PATENT DOCUMENTS

| | | | |
|---|---|---|---|
| 1,702,763 | 2/1929 | Clark | 101/234 |
| 2,756,673 | 7/1956 | George | 101/233 |
| 3,438,323 | 4/1969 | Smitzer et al. | 101/233 |
| 3,782,277 | 1/1974 | Neal | 101/76 |
| 3,963,339 | 6/1976 | Taylor et al. | 271/10 X |
| 3,985,073 | 10/1976 | Keller | 101/76 |
| 4,015,523 | 4/1977 | Evans et al. | 101/233 |
| 4,019,435 | 4/1977 | Davis | 101/242 X |
| 4,044,666 | 8/1977 | Doucet | 101/76 |
| 4,102,264 | 7/1978 | Sommers et al. | 101/77 |
| 4,135,804 | 1/1979 | Schoppe et al. | 271/245 X |
| 4,306,496 | 12/1981 | Charbonneau et al. | 101/76 |
| 4,353,540 | 10/1982 | Beery | 271/245 X |

*Primary Examiner*—Clifford D. Crowder
*Attorney, Agent, or Firm*—John J. Kowalik

[57] ABSTRACT

A printing machine having a roller and a printing head which are brought together for printing in a printing mode and separated in an nonimprinting mode, the disposition of the roller and the head being controlled by means sensing the presence or absence respectively of paper stock in position for imprinting. The invention comprises a positive auxilliary feeding mechanism.

9 Claims, 12 Drawing Figures

89
10
11
93a
92
104
8
95
94
103
93
14
6
114
119
5a.
86
82
88
90
83
84
85
5
87
7
13
12
60
4
3
55

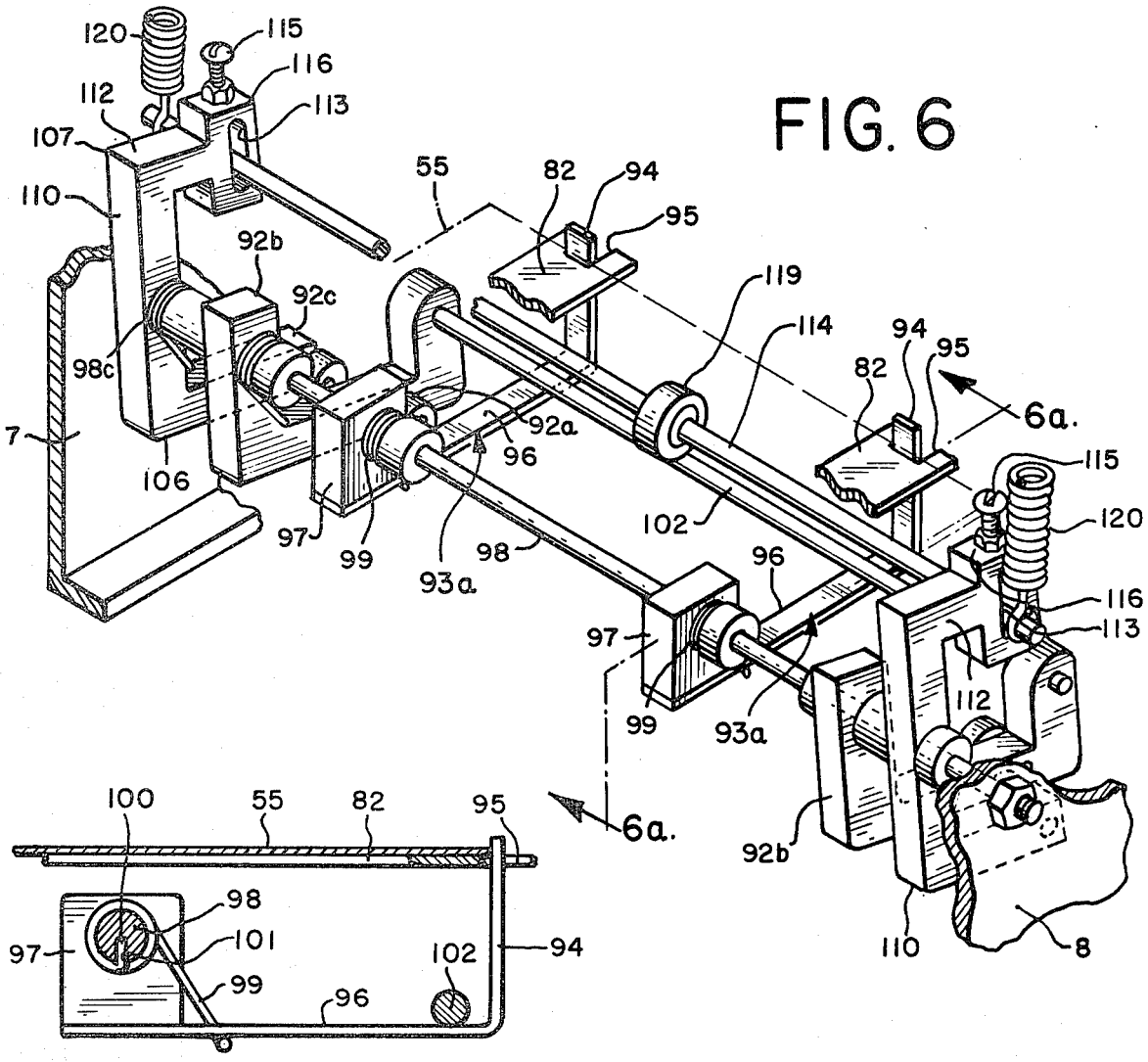
FIG. 6
FIG. 6a
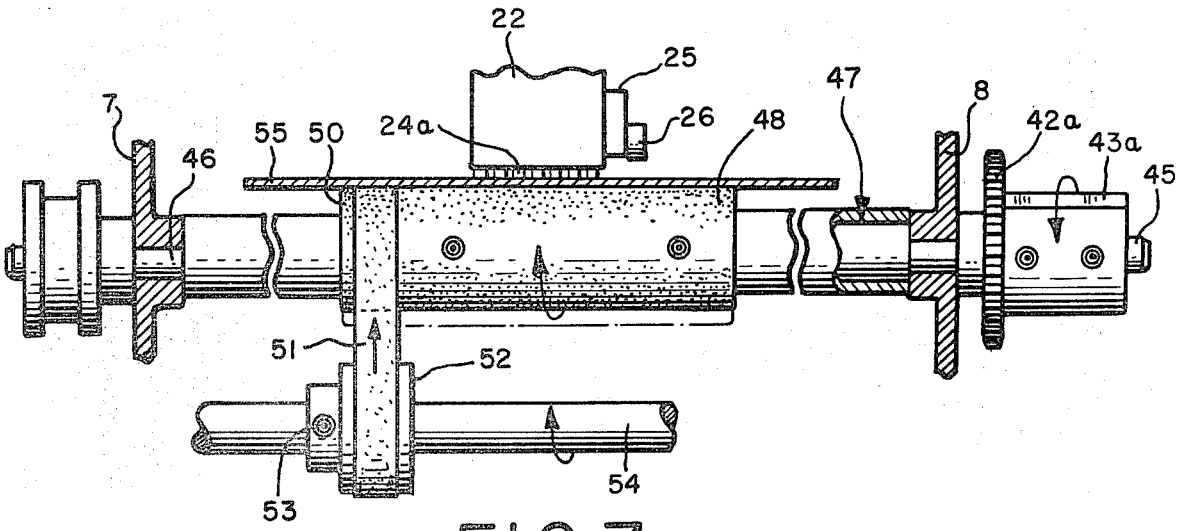
FIG. 7a

12 VAC
V1
S1
S2
S3
S4
K1
N.O.
NC
NO
C

ARTICLE CONTROLLED SHEET FEEDING AND PRINTING MACHINE

This is a continuation-in-part of application Ser. No. 257,557 filed Apr. 27, 1981, now abandoned.

BACKGROUND OF THE INVENTION

This invention relates to the art of printing and more specifically to a numbering component thereof. Numbering of forms for various uses is desirable as well as the precise placement of such numbers in a predetermined sequence and placement on the imprinted stock material.

DISCUSSION OF THE PRIOR ART

Numbering imprinters of the prior art are machines which are expensive and normally of limited use. They are built to guide the paper accurately through precisely timed stations. The parts are of standard well known constructions used for many years in the art. Such machines usually require a highly experienced operator to run and adjust for different printing jobs. Because of the initial capital expense, only printers who have constant use of such numbering printers will purchase one. The so-called small jobs can not be accommodated at reasonable cost.

SUMMARY OF THE INVENTION

This invention is directed to a novel printing apparatus which incorporates a simple but effective numbering component. The invention comprehends rotatably mounting a numbering printing head which wipes over ink rollers and then swings over and imprints paper stock which is delivered tangentially to the path of the head into contact therewith at a linear speed corresponding to the peripheral speed of rotation of the imprinting head so that there is no movement of translation therebetween and thus smearing is prevented.

The invention contemplates the provision of a novel mechanism which senses the disposition of the stock to be imprinted and disposes the imprinting mechanism in an imprinting mode, and which senses the absence of such stock and disposes the imprinting mechanism in a non-imprinting mode.

More specifically the invention comprises a rotary printing head which preferably continuously rotates, and an imprinting roller positioned therebeneath, the peripheral speed of the roller and the head being synchronized, and wherein the roller is mounted on a clutch-operated shaft which causes the eccentric shaft to raise the roller to printing position when the stock is present and to lower the roller out of printing position when the mechanism senses that no stock is present.

The invention also relates the number counter to be actuated when the head imprints a number, and more specifically to a novel arrangement for changing the number on the head to the next in the series.

These and other objects and advantages of the invention will become more apparent from the specification and the drawings, wherein.

Figures 5, 5A:
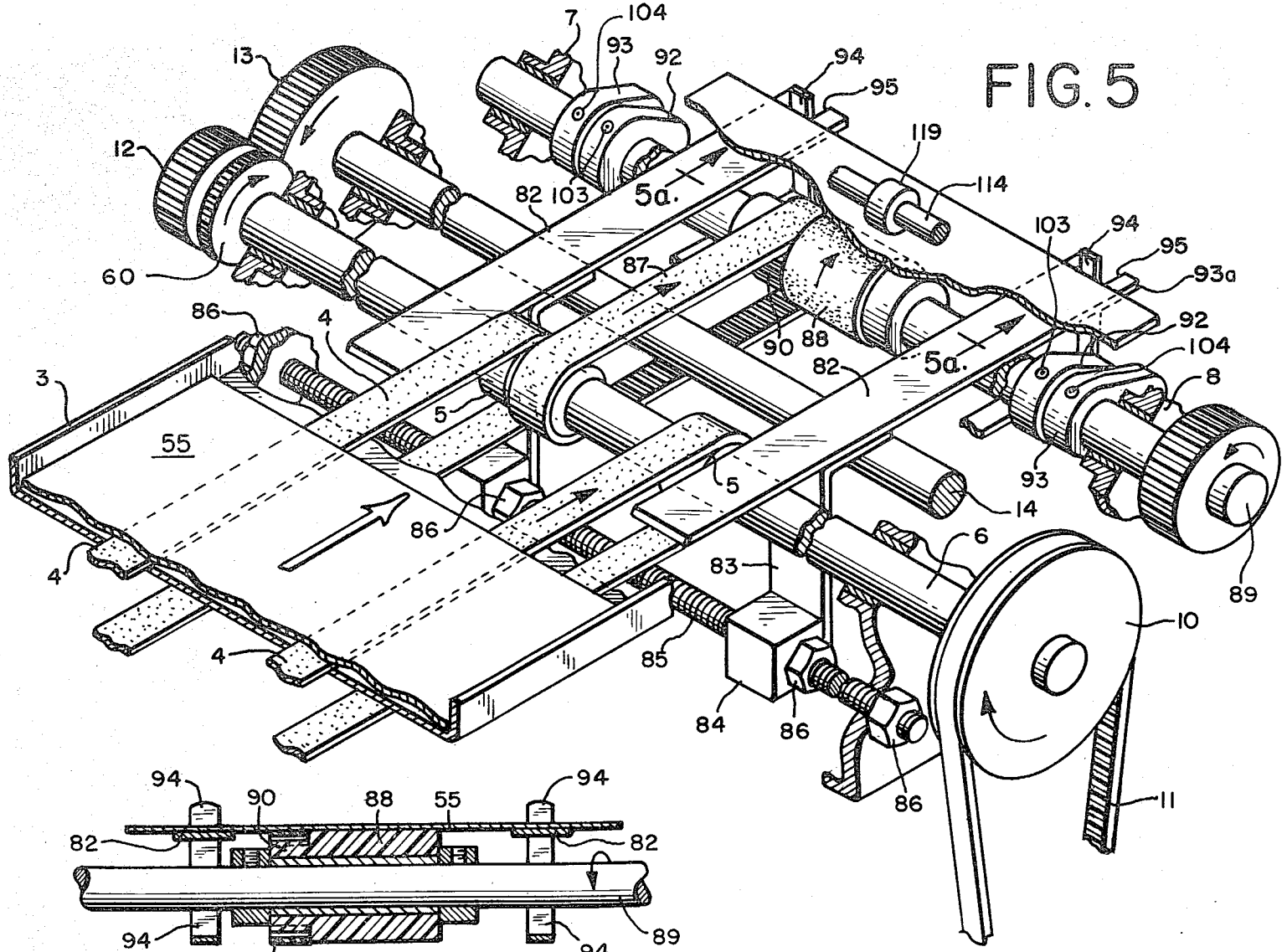
FIG. 5 is a fragmentary top perspective view of the mechanism with parts broken away for clarity.
Figures 7, 8, 9:
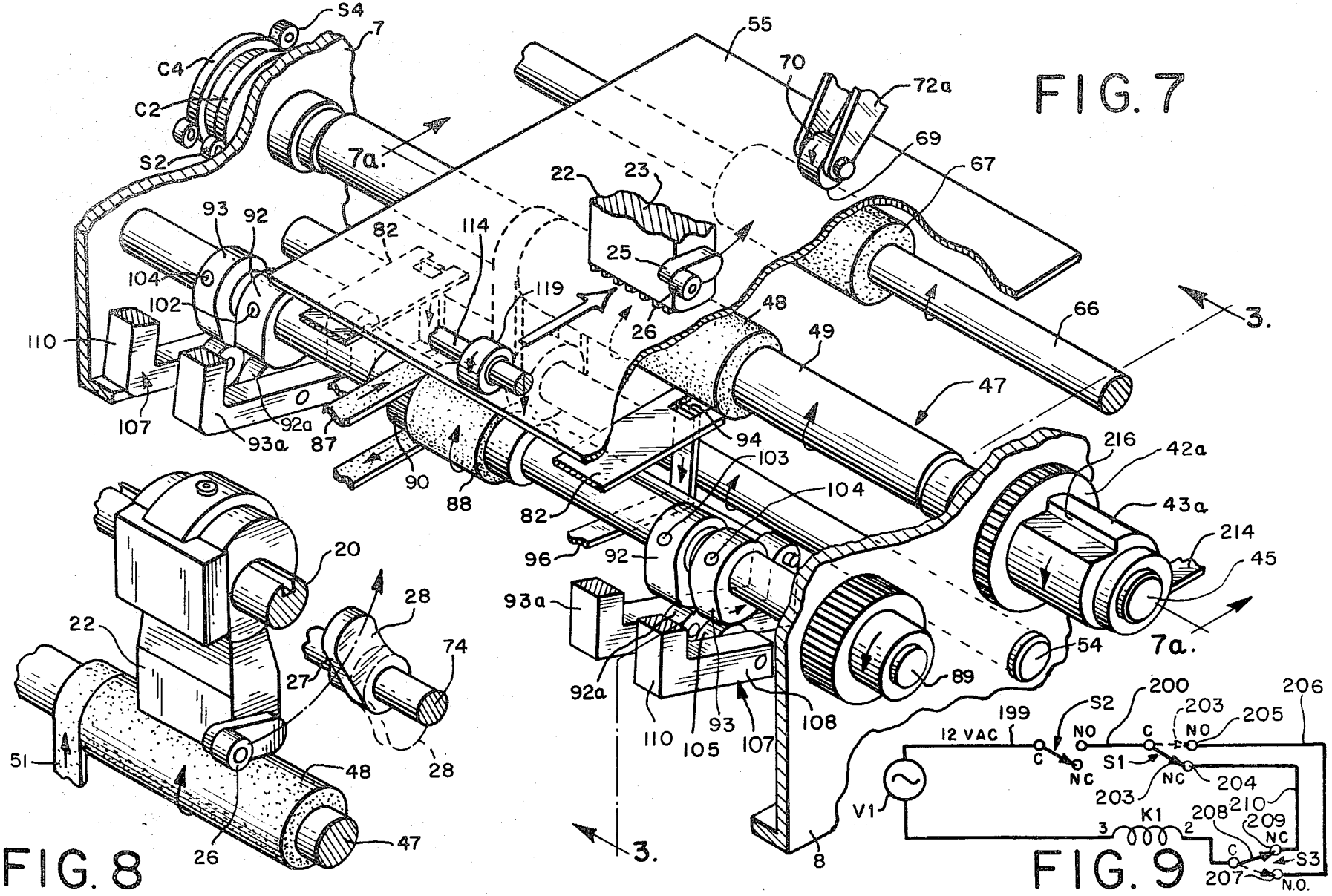

FIG. 5*a* is a section taken on line 5*a*—5*a* of FIG. 5;

FIG. 6 is a top perspective view of the fingerstop mechanism;

FIG. 6*a* is a cross-section taken substantially on line 6*a*—6*a* of FIG. 6;

FIG. 7 is a perspective view similar to FIG. 5 but downstream thereof;

FIG. 7*a* is a section taken on line 7*a*—7*a* of FIG. 7 showing the roller in imprint position;

FIG. 8 is a perspective view of a portion of the roller and printing head and number changing cam arrangement therefor.

FIG. 9 is a circuit diagram of the switch arrangement.

DESCRIPTION OF THE INVENTION

The invention is shown in association with a feeder mechanism fragmentarily shown at 2 and comprises a delivery tray 3 and paper stock carrying belts 4 which are trained about suitable drive wheels 5 mounted and connected to a transverse shaft 6 which is suitably journalled in side plates 7 and 8.

Shaft 6 is connected at one end to a toothed gear 10 which is driven by a toothed belt 11 from an electric drive motor 11*a*. The shaft 6 is keyed at its other end to a spur gear 12 which meshes with a spur gear 13 connected to a counter shaft 14 which is journalled in the side plates 7 and 8 substantially parallel with shaft 6 and rotates counterrotationally with respect thereto. Shaft 14 is connected at its other end to a sprocket 16 which drives a chain 17 which is tightened by an idler sprocket 18 adjustably mounted on the side plate 8. Chain 17 is trained about a sprocket 20 which is connected to a printer-head drive shaft 21 also extending between side plates 7 and 8 and journalled therefrom.

The shaft 21 mounts the imprinter head 22 of conventional type which has a body 23 with a clamp 24 at one end which is secured on shaft 21 and keyed by a slot and key 22*a*, and is adjustable along the length of shaft 21 and held by a set screw 24'. The imprinter head comprises a counter mechanism including a series of disks with raised numbers 24*a* which are advanced by an arm 25 which at its distal end has a striker or cam follower 26 adapted to engage a cam face 27 of a cam 28 when the cam 28 is in proper position as hereinafter explained. It will be noted that the print head or imprinter 22 is continuously revolving with the shaft 21.

The shaft 21 also drives a pulley 29 which drives a belt 30, the belt driving a pulley (not shown) journalled on shaft 32, the pulley including a spur gear 34 which meshes with and drives spur gears 36,38 which are connected with shafts 39,40 also journalled on side plates 7,8. The shafts 39,40 are keyed to inking rollers 42,43 which are adjustable along the length of these shafts in cooperative alignment with its associated imprinter head 22. The gear ratios are so chosen that the inking rollers are so rotated that their peripheral speeds are slightly different (faster or slower) than that of the imprinter head so that the numbers (lettering) thereon will not wipe at the same location every revolution. The inking rollers rotate in the same direction as the imprinter head to prevent scuffing. Chain 17 also drives a sprocket 42*a* which is connected to one element of a clutch 43*a* rotatably mounted on one of the eccentric end portions 45,46 of shaft 47. Said portions 45,46 mount the shaft generally indicated 47 directly below shaft 21. Shaft 47 rotatably supports an imprinting roller 48 on an intermediate portion 49 of the shaft 47 which is eccentrically disposed to portions 45,46 and is intergrally connected at opposite ends thereto as best seen in FIG. 7*a*.

The imprint roller 48 is preferably a sleeve of plastic material such as "Delrin" or polypropylene or polyethylene or the like, and has a grooved pulley 50 connected to one end thereof. The roller 48 is continuously driven by a belt 51 which is entrained about a pulley 52 suitably keyed as by a locking screw 53 to a drive shaft 54.

Shaft 54 parallels shaft 47 and is located therebelow and thus when the shaft 47 is elevated to dispose the imprint roller 48 thereon to imprint position, the belt tightens. The drive between the shaft 54 and the roller 48 is positive since the belt 51 and the pulleys 50 and 52 are provided with meshing teeth. It will be seen that the roller 48 is of such dimensions and rotates in a sweep direction of the imprint head at the essentially same peripheral speed, so that the stock 55, which is passed therebetween, moves at the same speed and thus no shifting occurs so that the imprint is clear without blurring or smearing.

The shaft 54 is journalled from the side panels 7,8 and is driven from a sprocket 57 connected to one end of shaft 54. A chain 58 is entrained about sprocket 57 and a tension adjusting sprocket 59 mounted on the related side plate. The chain 58 is driven from shaft 6 by means of a sprocket 61 connected thereto. Shaft 54 is also connected to a sprocket 62 which drives a chain 64 which is entrained on a sprocket 65 which drives a shaft 66 which drives a pull-out roller 67, said shaft extending through and being journalled on the side plates 7,8.

The pull-out roller 67 is located on substantially the same horizontal plane as the imprint roller downstream thereof, and the paper stock which exists from between the imprint roller and the imprinting head is fed into the nip 69 defined between pull-out roller 67 and a spring pressed hold-down roller 70 which is suitably supported on an arm 72*a* from the framework, namely, the necessary tie rod and mounting (not shown) on the side plates.

The imprint head mounting shaft 21 has a sprocket driving a chain 73' which drives a sprocket 150 rotatably mounted on a stub shaft 151 which is mounted on the side plate 8. Sprocket 150 is connected to a spur gear 152 which meshes with spur gear 153 connected to and driving shaft 89.

Figure 1:
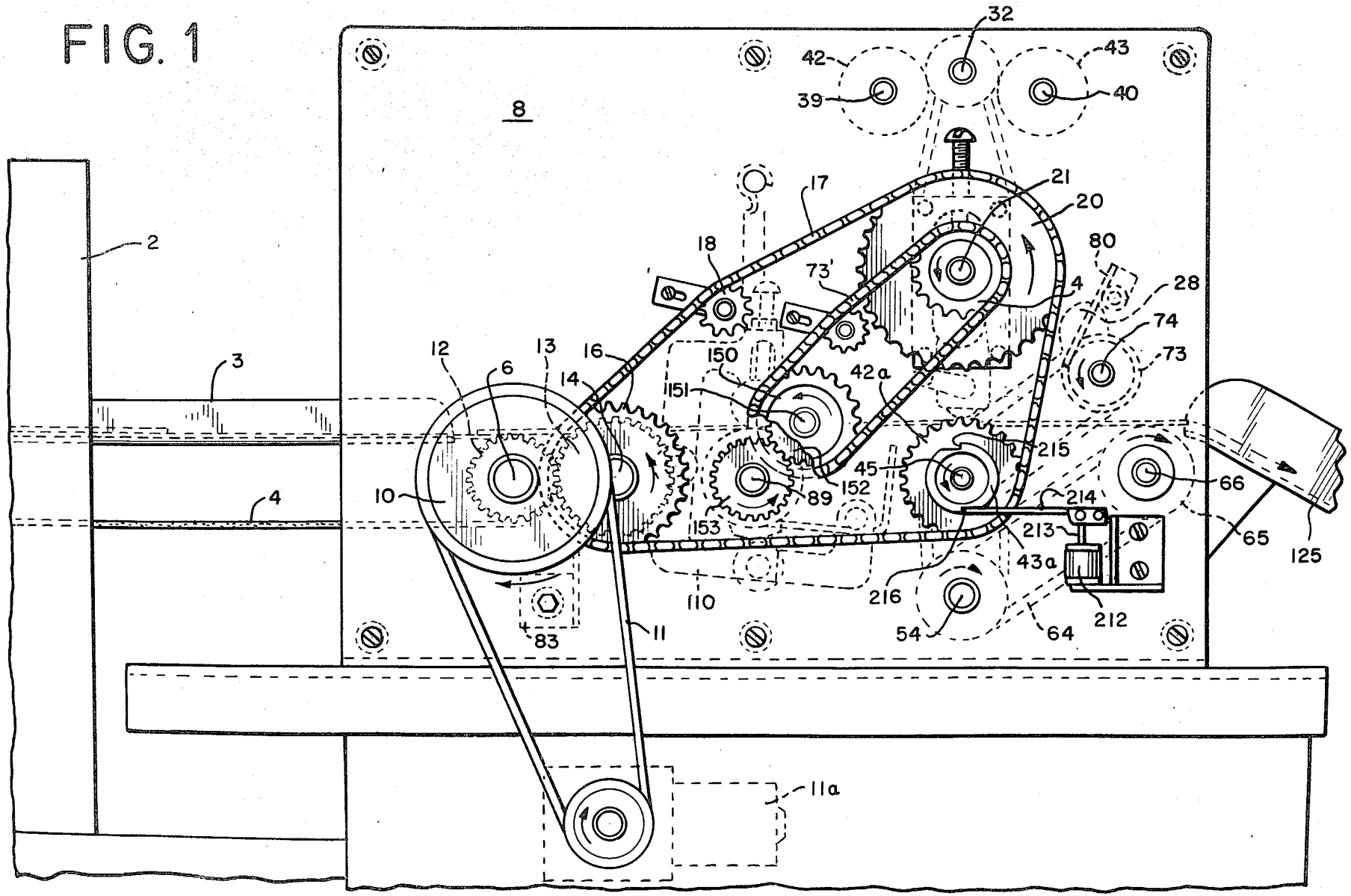
FIG. 1 is a side elevational view of one side of my novel imprinter.
Figure 2:
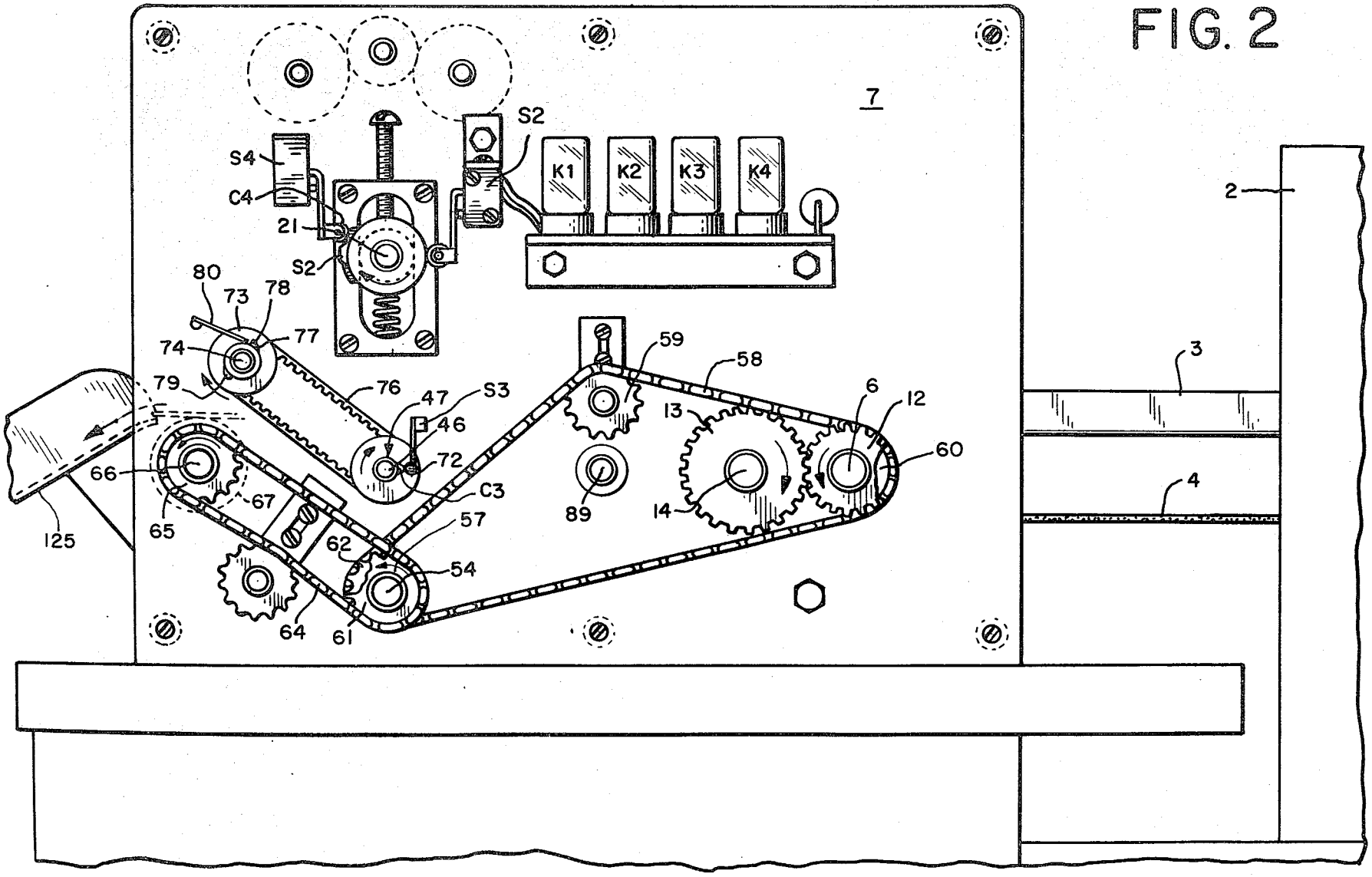
FIG. 2 is a side elevational view of the opposite side thereof.
Figure 3:
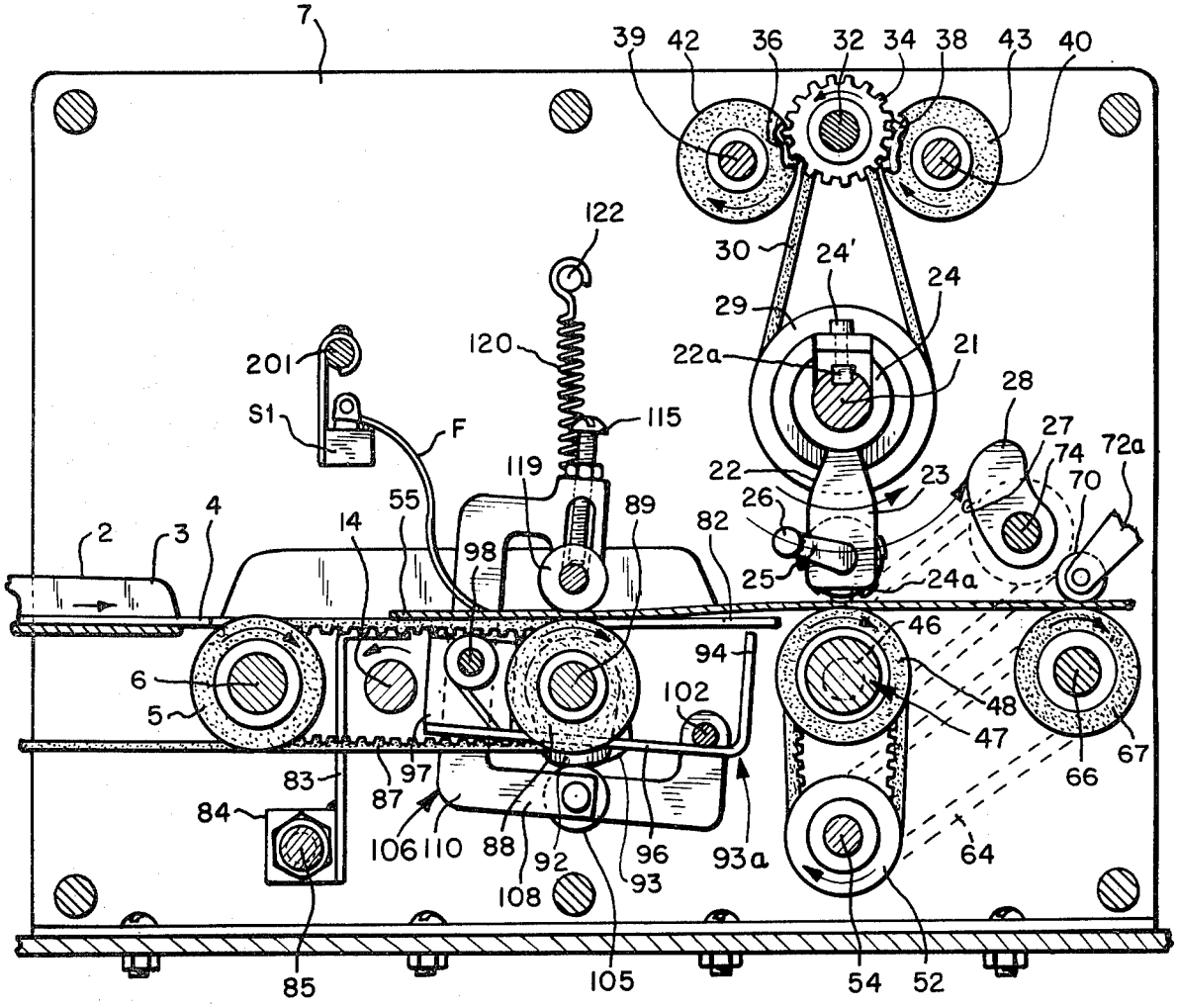
FIG. 3 is a vertical cross-sectional view taken substantially on line 3—3 of FIG. 7 showing the imprinting position of the mechanism.
Figure 4:
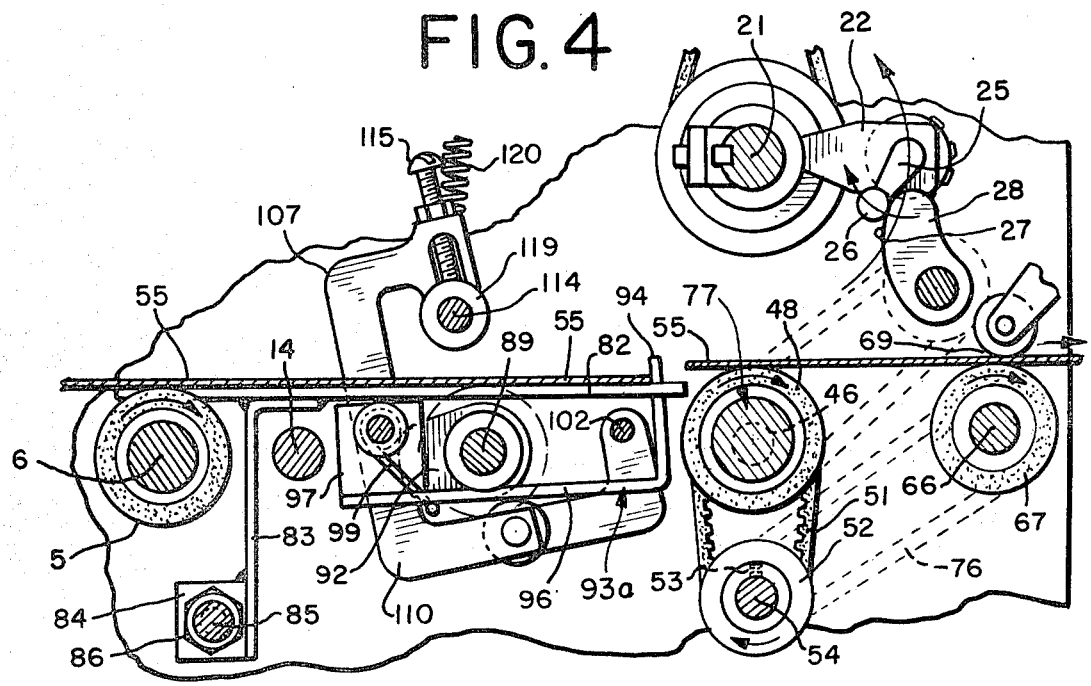
FIG. 4 is a further vertical cross-sectional view taken substantially on line 3—3 of FIG. 7, showing a position of the mechanism subsequent to imprinting.

The imprint roller 48 mounted on shaft 47 drives a toothed pulley 72 (FIG. 2) about which is entrained a cog belt 76 driving a toothed pulley 73 that is connected to cam shaft 74 which is suitably journalled on the side plates 7,8. The cam 28 is mounted on the shaft 74 and is adapted to be screw locked to the shaft 74 in any selected position along the length thereof in position for cooperation with the cam follower 26. It will be noted that each time that the clutch 43*a* is actuated as hereinafter explained, the shafts 47 and 74 each rotate a half turn together. If the shaft 47 is in the raised position, the cam 28 will be in a position to be engaged by the cam follower 26. It will be noted that the shaft 74 is connected to a one-way ratchet 77 with a pair of diametrically opposed teeth 78,79. A spring pressed pawl 80 is mounted on the adjacent side plate and rides over the teeth 78,79 when the shaft 74 is driven. However, when the shaft 74 is stopped and the cam 28 is in engaging position to the follower 26, the ratchet 77 is so designed that tooth 78 or 79 will overtravel the pawl. The follower upon striking the cam 28, which is shown in operating position in FIGS. 3 and 4, will slightly rock the shaft 74 in a clockwise direction (FIGS. 3 and 4), tensioning the belt 76 until the tooth 78 or 79 engages the respective pawl. This simple inexpensive mechanism thus provides an accurate placement of the cam. When the shaft 47 is rotated in a clockwise direction (FIGS. 3 and 4) by the clutch 43 being tripped by a signal of no paper stock being delivered (absence of stock), the cam 28 is positioned as shown in FIG. 8 in phantom lines out of the path of the follower 26.

The paper stock shown at 55 in FIG. 5 moves on the conveyor belts 4 at a premeasured rate and slides over metal guides 82 which are connected to depending brackets 83 that are welded at their lower ends to mounting blocks 84. Blocks 84 are threaded onto a threaded rod 85 which extends through openings in the side plates 7,8 and is secured thereto by nuts 86. The blocks 84 are shiftable by threading and rethreading with respect to rod 85, whereby the guides 82 are positionable laterally between the side plates, whereupon the blocks 84 are locked by nuts 86. The paper stock 55 is carried on a conveyor belt 87 over a feed roller 88 which is rotatable on a shaft 89, which extends through side plates 7 and 8 and is journalled thereon. The roller 88 is connected at one end to a toothed pulley 90 upon which the conveyor belt 87 is trained.

The shaft 89 mounts two sets of cams 92,93. The cams 92 operate the paper stock finger stop assemblies 93*a*, each of which comprises a vertical digit portion 94 which in raised paper stock-stopping position extends through notches 95 in the distal ends of guide bars 82 to a predetermined distance thereabove. The lower end of each portion 94 is connected to the front end of a reach 96 which at its rear end is secured to a bearing block 97 sleeved over a pivot rod 98 which extends through plates 7 and 8 and is secured thereto. A torsion spring 99 is sleeved over rod 98 adjacent to each finger assembly and has one end hooked under the related reach, and the other end 100 hooked into a longitudinal slot 101 in the rod 98. Thus each finger assembly is biased upwardly and holds its associated reach against an actuating bar 102 extending thereabove. Each cam 92 is adjustably set circumferentially about the shaft 89, as well as axially by a set screw 103.

Each cam 92 rides on a follower roller 92*a* of an actuator 92*b* which is of C-shape and has one end pivoted on shaft 98 and its other end connected to rod 102. Each actuator is lifted by a torsion spring 98*c* mounted on shaft 98. Thus it will be seen that the finger assemblies which are very lightly biased upwardly can move downwardly independently of the cammed push bar or rod 102.

The cams 93 which are also adjustable circumferentially and axially on shaft 89 are set by set screws 104 and each rides over a follower 105 on a horizontal bottom leg 106 of a take-up roller carrier 107.

As best seen in FIG. 6 there are two such carriers, each having a lower horizontal leg 108 and an upright rear pendular leg 110. The rear legs 110 have a pivot mount intermediate their ends from the rod 98. The upper ends of legs 110 have forward extrusions 112 with vertically elongated slots 113 through which extends a shaft 114 which is vertically adjustable by adjusting screws 115, each threaded through a top portion 116 of extension 112 into the slot 113 therebelow, and engaging the top of the shaft 114 extending through slot 113. The shaft 114 journals a presser wheel 119 which may have a soft rubber cover, said wheel opposing the feeder roller 88 and forming an auxiliary feed therewith. The carriers are biased in a counterclockwise direction (FIG. 6) by tension springs 120 which at their lower ends are hooked to the respective ends of shaft 114 and at their upper ends are hooked to pins 122 mounted thereabove on respective side plates. The arrangement is such that upon the paper stock 55 engaging the fingers 94, the presser roller 119 is brought down against the roller 88 and together with the roller 88 forming delivery means grasping the stock 55 therebetween. The fingers 94 start to lower while the paper very slightly bows up. The paper is then released by the fingers and runs over the imprint roller 48 which has been raised or is held in the raised position in an imprint mode. The speed ratios of all conveying elements are so determined that the paper advances a predetermined distance before the imprinter head imprints the number. The paper stock then passes to the pull-out rollers 67,70 and is discharged into a suitable tray 125 or the like.

A low voltage circuit is used to operate switches S1,S2,S3,S4 and control relays K1,K2,K3, and K4. Cam C4 is mounted on the continuously rotating shaft 21 and operates switch S4 on each revolution, thus actuating conventional circuitry (not shown) for driving the conveyors of feeder 2 to deliver one stock item 55 to the belts 4. The stock 55 moves to fingers 94,94 and closes switch S1 by lifting the sensng finger F thereof.

As best seen in FIG. 9 of the drawings, the low voltage source V1 has one lead 199 connected to switch S2 which is actuated by cam C2 mounted on and rotating with shaft 21. Switch S2 upon being closed provides a current path through lead 200 to one contact 203 of switch S1. Switch S1 is mounted from the side plates 7,8 on a support bar 20 and overlies the path of the paper stock 55. Upon stock 55 being sensed as present, switch S1 is moved from a first closed position opening contacts 203,204 to a second closed position which closes contact 203 with contact 205 which provides a current path via lead 206 to contact 207 of switch S3.

Switch S3 is in the open operated position, which means contact 208 is closed with contact 207 and the current path goes through S3 to relay K1. Relay K1 thus operates solenoid 212 and causes pawl 214 to release from tooth 216 of clutch 43*a*, allowing shaft 47 to rotate one-half revolution to raise or lower the impression roller depending upon the initial position thereof.

However, if the switch S1 senses that there is no stock on the conveyor for delivery to the imprinter, the contact 205 of switch S1 is then closed with contact 204 and provides a current path through line 210 to contact 209 and through contact 208 of switch 53; the current flows to relay K1 which operates solenoid 212 and causes the pawl 214 to be retracted by armature 213 to release the pawl from tooth 216 of clutch 43*a*, allowing shaft 45 to rotate one-half revolution to drop the impression roller 48 and engage tooth 215 with pawl 214.

As the shaft 47 rotates the cam C3 which operates switch 53 rotates and actuates the switch 53 to its second position. It will be seen that the circuit provides control for the position of the imprinting roller. As long as stock is being sensed as being present by switch 51, the impression roller will remain in raised position and the cam 28 will be in striking position to the counter arm roller 26. If the paper stock is not present then the circuit will cause the mechanism to drop the imprinting roller and the cam 28 to move out of engaging position.

As best seen in FIGS. 5 and 7, the conveyor belt 87 terminates short of the fingers or gates 94 and the paper stock merely lays upon the smooth guide rails 82,82. The paper or stock-contacting surface of the continuously moving belt 87 has a coefficient of friction such that when the paper is released from between the rollers 119 and 88 it is abraded by the belt and urged toward the fingers, and since there is no obstruction thereabove in the space between the rollers 88,119 and the fingers or gate means 94, the thin paper is caused to bow or bend slightly upwardly. Thus it will be seen that the machine includes feeding means comprising the moving belt 87 having frictional contact with the stock material positioned thereon and being slidable under the stock material attendant to the stock material being stopped by the fingers or gates 94 which function as stopping means. The belt 87 has a coefficient of friction sufficient to cause the stock material, in the stopped condition, to bow at its leading end portion while the belt 87 moves abradingly thereunder. Subsequently, upon the paper being grasped between the rollers 119 and 88, which occurs slightly before the fingers are fully retracted, the paper since it is bowed will not be mashed at its leading edge against the fingers by the paper being forcibly delivered toward the imprinter. The stock will spring forward over the tops of the fingers as they descend and disappear below the level of the guides 82. I have found that belts which contain natural or synthetic rubber will provide a sufficient coefficient of friction for present day typical writing or printing papers to obtain the desired objectives heretofore described.

I claim:

1. An imprinting machine comprising means for feeding sheet stock material sequentially at a predetermined rate, means for imprinting said material disposed in receiving relation to said feeding means, means for sensing the presence or absence of stock material being delivered by said feeding means in position to be imprinted, means for conditioning said imprinting means to imprinting and non-imprinting modes, means coupling said imprinting means with said sensing means for conditioning said imprinting means to said imprinting mode attendant to said sensing means sensing the presence of said material positioned to be imprinted, and for conditioning said imprinting means to a non-imprinting mode attendant to said sensing means sensing the absence of said material to be imprinted, downwardly retractable stop finger means engageable with each sheet of said stock material being sequentially fed by said feeding means and thereafter movable to a sheet releasing position, said feeding means having a slidable frictional supporting contact with each sheet and being arranged to urge each sheet, while sliding thereunder, against said finger means to bow a forward portion of each sheet just prior to release of the sheet by said finger means for feeding into said imprinting means, the spring reaction of the forward portion of the sheet effected by the bowing of each sheet forming automatic advancing means for the forward portion of each sheet for advancing each sheet over said finger means when said finger means releases the sheet, means for coupling said finger means with said feeding means for actuation in timed relation to the operation of said feeding means, and delivery means cooperative with said feeding means for grasping the rear end portion of the sheet for positively advancing the sheet coincidentally with the retraction of the finger means and release of the sheet.

2. The invention according to claim 1, wherein said imprinting means comprises an imprinting head and an imprinting roller disposed in opposing relation and wherein in said imprinting mode said head and roller are positioned in cooperative relation for imprinting on the stock material passing therebetween and wherein in the non-imprinting mode said head and roller are separated.

3. The invention according to claim 2 and wherein said conditioning means comprises means for shifting said roller toward and away with respect to said imprinting head.

4. The invention according to claim 1 and said delivery means for positively feeding the stock material comprising means movable from an inoperative position into sequential engaged position with each piece of stock material being delivered on said feeding means to selectively momentarily urge the same in delivering direction in accordance with a predetermined disposition of said imprinting head for continued delivery by said feeding means to said imprinting means in predetermined timed relation therewith.

5. The invention according to claim 4 and said delivery means comprising feed roller means upon being disposed in cooperative position grasping each piece of stock material as it is being released by said stop finger means and positively feeding said stock material into said imprinting means.

6. An imprinting machine comprising: means for imprinting stock material, means for feeding said stock material to said imprinting means, said imprinting means comprising an imprinting head and an opposing impression roller therebeneath, means for selectively relatively moving said roller and said head to imprinting mode and to non-imprinting mode, sensing means for sensing the presence or absence of stock material on said feeding means and operative upon sensing such presence to position said imprinting means in an imprinting mode, and upon sensing such absence to position said imprinting means in a non-imprinting mode, said last-mentioned means comprising eccentric means mounting said impression roller for movement between said modes, drive means for said eccentric means, means for stopping feed of said stock material attendant to said imprinting means being positioned in a non-imprinting mode and alternately conditioning said feeding means to feed said stock material attendant to said imprinting means being placed in an imprinting mode, means connecting said drive means to said stopping and conditioning means, said feeding means comprising a moving belt having frictional contact with the stock material positioned thereon and slidable under the stock material attendant to the stock material being stopped by said stopping means, said belt having a coefficient of friction sufficient to cause said stock material, in its stopped condition, to bow at its leading end portion while the belt moves abradingly thereunder, and means for positively assisting said feeding means to feed said stock material to the imprinting means coincidentaly with said stock material being released by said stopping means to forcibly move the stock material into the imprinting means as the bowed portion of the stock material springs towards said imprinting means.

7. An imprinting machine comprising means for imprinting stock items, means for feeding said stock items in sequence individually to said imprinting means and including means for forcibly delivering each item at a certain stage to said imprinting means, said imprinting means comprising an imprinting head, impression means opposing said head, means mounting said impression means and head to move relatively between an imprinting mode whereat the material is forcibly delivered thereto and to move to a non-imprinting mode, gate means having open and stop positions arranged in timed sequence with the imprinting means for stopping advance of an item to the imprinting means attandant to the latter being disposed in non-imprinting mode, said feeding means comprising means for uniformly lightly biasing each item toward the gate when in stop position and having sliding frictional contact therewith and continuously transmitting sufficient force to bend the item until the gate means is conditioned to move to open position whereupon the item is free to expand and spring over the gate means toward the imprinting means attendant to initiation of said forcible delivery means ejecting the item toward the imprinting means and concurrently with said imprinting means reverting from non-imprinting mode to imprinting mode.

8. The invention according to claim 7 and said means for forcibly delivering each item including rotating elements adapted to grasp each article and move the same only momentarily during the interval between gate open and gate stop positions.

9. The invention according to claim 7 and said head being mounted on a fixed axis and said impression means being mounted on an eccentric and being swingable toward and away with respect to said head, and means coupling said eccentric with said delivery means for conjunctive action to effect said operation thereof.

* * * * *